United States Patent [19]

Luebbers

[11] 4,444,111

[45] Apr. 24, 1984

[54] CROWD CONTROL PROJECTILE AND METHOD OF EJECTING SAME

[75] Inventor: Willi Luebbers, Trittau, Fed. Rep. of Germany

[73] Assignee: Nico-Pyrotechnik Hanns-Juergen Diederichs KG, Trittau, Fed. Rep. of Germany

[21] Appl. No.: 352,369

[22] Filed: Feb. 25, 1982

Related U.S. Application Data

[63] Continuation-in-part of Ser. No. 080,052, Sep. 28, 1979, abandoned.

[30] Foreign Application Priority Data

Sep. 30, 1978 [DE] Fed. Rep. of Germany ..... 2842797

[51] Int. Cl.[3] ..... F42B 4/14; F42B 27/06

[52] U.S. Cl. ..... 102/360; 102/334; 102/368

[58] Field of Search ..... 102/367–370, 102/334, 364, 345, 360

[56] References Cited

U.S. PATENT DOCUMENTS

| | | | |
|---|---|---|---|
| 1,770,921 | 7/1930 | Hitt | 102/360 |
| 1,823,304 | 9/1931 | Weller | 102/367 |
| 1,922,156 | 8/1933 | Fabrizio | 102/360 |
| 2,079,008 | 5/1937 | Goss | 102/368 |
| 2,094,562 | 9/1937 | Lowy | 102/368 |
| 2,340,329 | 2/1944 | King | 102/334 |
| 2,396,064 | 3/1946 | VanKarner | 102/487 |
| 2,715,365 | 8/1955 | Godchaux et al. | 102/275.3 |
| 3,188,955 | 6/1965 | Brown | 102/306 |
| 3,372,641 | 3/1968 | Foster | 102/334 |
| 3,380,383 | 4/1968 | Schnepfe, Jr. | 102/368 |
| 3,404,810 | 10/1968 | Beers | 102/482 |
| 3,718,090 | 2/1973 | Gregory | 102/487 |
| 3,782,285 | 1/1974 | Froehner | 102/340 |
| 4,119,040 | 10/1978 | Lerman | 102/277.2 |
| 4,171,669 | 10/1979 | Allen | 102/357 |

FOREIGN PATENT DOCUMENTS 1170180 11/1969 United Kingdom .

*Primary Examiner*—Charles T. Jordan

[57] ABSTRACT

Crowd control projectile and a method of ejecting flash and acoustic shock charges from said crowd control projectile. The projectile comprises a housing containing a fuse acting on a delay charge for igniting an ejector charge and at least one charge which can be ejected from the housing without destroying the housing. The projectile has a lid which is blown off by a slight pressure build-up in the container and at least one flash and acoustic shock charge arranged in a tube which is disposed in the housing together with an ejector and scatter charge which is ignited by the delay charge via a fuse cord. The crowd control projectile may also contain a smoke or irritant substance charge disposed in a tube or separate compartment of the projectile which is adapted to be ignited by said delay charge.

In an alternate embodiment of the crowd control projectile the upper half of the projectile is constructed as described hereinabove and is mechanically connected to a lower half. A delay charge is interposed between the upper and lower half and ignites the lower half after a predetermined period of time. The lower half in turn has an ejector charge which is ignited by the interposed delay charge which in turn ejects at least one charge from the lower half of the projectile.

11 Claims, 6 Drawing Figures

FIG. 3
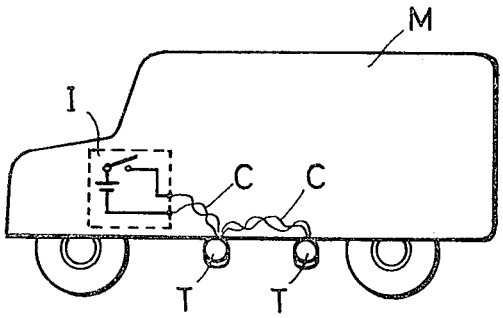
FIG. 4
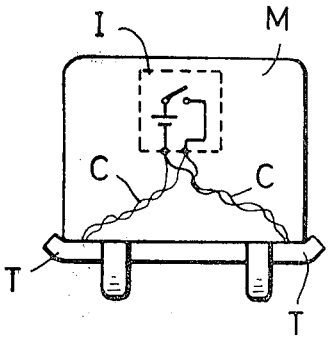
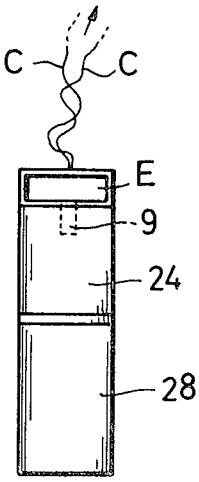
FIG. 6

CROWD CONTROL PROJECTILE AND METHOD OF EJECTING SAME

CROSS-REFERENCE TO RELATED APPLICATION

This application is a continuation-in-part of our copending application Ser. No. 080,052, filed on Sept. 28, 1979, now abandoned, and entitled CROWD CONTROL PROJECTILE.

BACKGROUND OF THE INVENTION

The invention relates to a crowd control projectile having a housing and a fuse arranged on the housing for igniting a delay charge for firing an ejector charge and at least one charge arranged in the housing which can be ejected without destroying the housing. The invention also relates to a method for ejecting such a projectile from a motor vehicle.

Projectiles of this type serve to disperse agitators or violent demonstrations by being thrown in the direction of same; after a certain period of time such projectiles give off smoke or an irritant gas. Such a projectile is described in British Pat. No. 1,170,180, in which after a certain period of delay an ejector charge is ignited by means of a trip lever fuse which first causes an opening to be blown in the housing of the projectile and subsequently causes the contents to be ejected from the housing.

Experience with this type of projectile has shown that they are frequently ineffective or are used by the agitators against the forces of law and order. Projectiles discharging tear gas, for example, can be defused and thus rendered ineffective. Furthermore, projectiles of this type can be thrown back in the direction of the police, since apart from the smoke and irritant gases being expelled there are no other effects connected with them, and particularly cold-blooded or suitably equipped demonstrators or agitators do not hesitate to catch such a projectile and throw it back.

SUMMARY OF THE INVENTION

It is the purpose of the present invention to provide a projectile of the afore-mentioned type which, without causing injury to the agitators or demonstrators, has such an effect on them that these are forced to flee or withdraw, and whereby the possibility of throwing the projectile back in the direction of the police is substantially eliminated.

The projectile in accordance with the invention comprises a housing or container containing a fuse acting on a delay charge for igniting an ejector charge and at least one charge which can be ejected from the housing without destroying the housing. The projectile has a lid which is blown off by a slight pressure build-up in the housing and at least one flash and acoustic shock charge arranged in a tube disposed in the housing together with an ejector and scatter charge which is ignited by the delay charge.

Preferably the projectile of the invention has a plurality of elongated cylindrical flash and acoustic shock charges disposed in tubes which are arranged parallel to each other in the housing, each flash and acoustic shock charge tube having an ejector and scatter charge and a fuse cord connecting the ejector and scatter charge with the delay charge. The ejector and scatter charge for the individual flash and acoustic shock charges may be of variable strength.

The individual fuse cords may be of different lengths and/or have different rates of burning. The trip-lever fuse may be arranged in the lid which is blown off, and may have at least one smoke or irritant substance charge which is ignited by a delay charge.

Finally, a smoke or irritant substance charge in the container may be kept separate from the flash and acoustic shock charge by a lateral wall and in the lateral wall there is provided a delay charge adapted to be ignited by a fuse cord.

By constructing the housing in such a way that the lid is blown off without destroying the housing, the possibility of injuring demonstrators or agitators through bits of the housing is reduced. The flash and acoustic shock charge arranged in the housing induces a strong psychological shock so that the demonstrators or agitators will not risk going near the smoke or irritant gas charge in order to make it harmless. If several flash and acoustic shock charges are used in a projectile with ejector and scatter charges of varying intensity which are fired at different times, the confusion is additionally increased and the chance that smoke or gas charges are lighted and thrown back is substantially reduced.

Such a projectile can be advantageously mounted in a launcher tube which is disposed on a motor vehicle in order to protect it from demonstrators. The launcher tubes can advantageously be mounted under the floor of the motor vehicle and are upwardly inclined so that the projectile can be launched along an arcuate trajectory. The flash and acoustic shock charge becomes effective against demonstrators attacking the motor vehicle. The fuse which ignites the ejector and scatter charge can be electrically ignited by a person located inside the vehicle.

A particularly effective crowd control projectile can be obtained by joining a first upper preferably cylindrical half of a projectile which is constructed as described hereinabove with a second lower preferably cylindrical half of a projectile. The two halves of the projectile are separated by a transverse wall which includes a delay charge. The delay charge ignites the scatter and ejector charges of the lower half only after a predetermined period of time has elapsed, thereby further increasing the crowd control and deterrent effect of the projectile. Such a composite projectile can, of course, also be launched by the afore-described launcher tubes of a motor vehicle.

Further details and advantages of the invention will become obvious from the description and the several embodiment examples represented by the drawings.

IN THE DRAWINGS

FIG. 1 is a schematic view in vertical cross-section through the projectile in accordance with a first embodiment of the invention, FIG. 2 is a schematic view in vertical cross-section of the projectile in accordance with a second embodiment of the invention, FIG. 3 is a schematic side elevational view of the motor vehicle with launcher tubes for ejecting the crowd control projectile of the invention;

FIG. 4 is a schematic end elevational view of the motor vehicle of FIG. 3;

FIG. 6 is a schematic view of the composite projectile of FIG. 5 in the form ready for launching from a launching tube of a motor vehicle.

DETAILED DESCRIPTION

Figure 1:
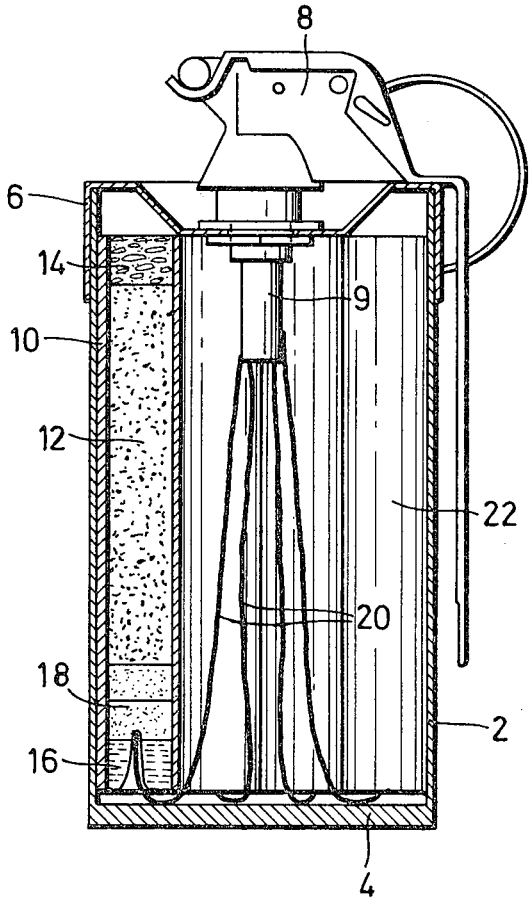

Turning first to FIG. 1, the first embodiment of the projectile according to the invention comprises a cylindrical sheet metal housing 2 having a base 4 and a lid 6 press fitted to the housing 2. Attached to the lid 6 is a trip-lever fuse 8 which is designed in the usual manner and does not form a part of the invention. A trip-lever of this kind is described in detail in British Pat. No. 1,170,180.

Fixed to the trip-lever fuse 8 is a pyrotechnic delay charge 9 which through a fuse cord 20 fires ejectable charges 12 which are described in more detail later. These ejectable charges comprise flash and acoustic shock charges 12 housed in elongated cylindrical cardboard tubes 10. The cardboard tubes 10 are provided at one end with a plug 14 and at the other end with a perforated stopper 16. The perforated stopper 16 receives a fuse cord 20. The fuse cord 20 ignites an ejector and scatter charge 18 arranged between the perforated stopper 16 and the flash and acoustic charge 12. Apart from several parallel arranged flash and acoustic shock charges 12 housed in elongated cylindrical cardboard tubes 10, it is also possible to provide smoke or irritant gas charges 22 arranged parallel thereto.

The length or rate of burning of the fuse cords 20 as well as the strength of the ejector and scatter charges 18 for the various flash and acoustic charges 12 in the elongated cylindrical tubes 10 may vary so that the flash and acoustic shock charges 12 or the smoke and irritant gas charges 22 are not ejected from the housing 10 and ignited at the same time.

The projectile according to the invention is ignited by pulling a cutter pin attached to the trip-lever fuse 8 and is thrown in the direction towards the agitators or demonstrators. The delay charge 9 ignites the fuse cords 20, and the lid 6 together with the trip-lever fuse 8 is then blown off the housing 10. Subsequently, the flash and acoustic shock charges 12 in the cardboard tubes 10 and the smoke and irritant gas charges 22 are ejected from the housing 10 and ignited, causing the development of very intense flashes and acoustic shocks, respectively, by producing smoke or irritant substances. Flash and acoustic shock producing charges of this type are known in the art and therefore are not described in detail.

The effect of these flash and acoustic shock charges 12 is that bodily damage to the agitators or demonstrators is avoided, at least when the explosion takes place at a minimum distance from the persons concerned, but the flash and acoustic shock effect on the agitators or demonstrators is such that their ability for coordinated action is severely restricted. It is therefore not to be expected that agitators or demonstrators thus shocked will defuse any projectile containing a tear gas charge thrown at them or that they will throw back the whole or parts of such a projectile.

Figure 2:
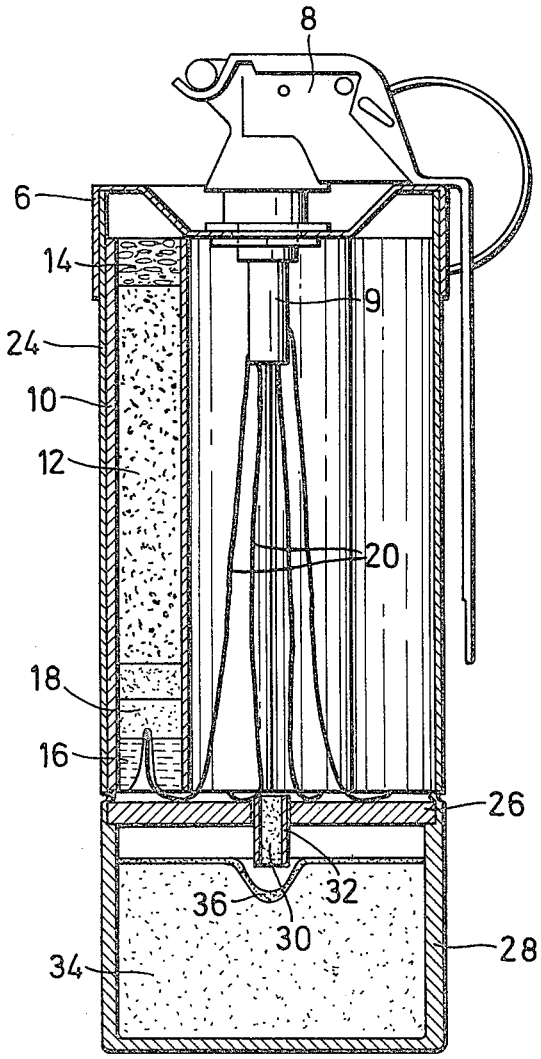

The embodiment according to FIG. 2 is the same in principle as the described in FIG. 1, and the same parts are designated by the same reference numerals.

In the embodiment according to FIG. 2 the housing 24 contains a partition 26. Partition 26 divides a lower cup 28 containing a smoke or irritant substance charge 34 from the upper chamber of the housing 24. The partition 26 is provided with tube 32 containing a second, additional delay charge 30. The delay charge 30 is connected with the delay charge 9 via a fuse cord 20. The delay charge 30 arranged in the tube 32 ignites a booster charge 36 arranged on the smoke or irritant substance charge 34. Thus apart from the flash and acoustic shock charges 12 housed in the cardboard tubes 10 this embodiment also has an intense smoke or irritant substance charge which is effective over a prolonged period.

As with the embodiment of FIG. 1, the flash and acoustic shock charges 12 of the embodiment of FIG. 2 with their explosions cause such a psychological shock that the smoke or irritant substance charge 34 after ignition can release its effect so that the agitators or demonstrators will not dare to go near the projectile in order to render it harmless.

There is illustrated in FIG. 3 a motor vehicle M having an ignition circuit I which is operatively connected by means of electrical conduits C to the launcher tubes T. It has been found particularly advantageous to launch the crowd control projectiles as described hereinabove, from a motor vehicle to discourage and control a crowd attacking such motor vehicle. The projectile of FIGS. 1 and 2 is mounted without the trip-lever fuse 8 in a launcher tube T and is ignited by means of the ignition circuit I via an electrical conduit C by a person inside the motor vehicle M to thereby be ejected and in turn ignite the delay charge 9.

Figure 5:
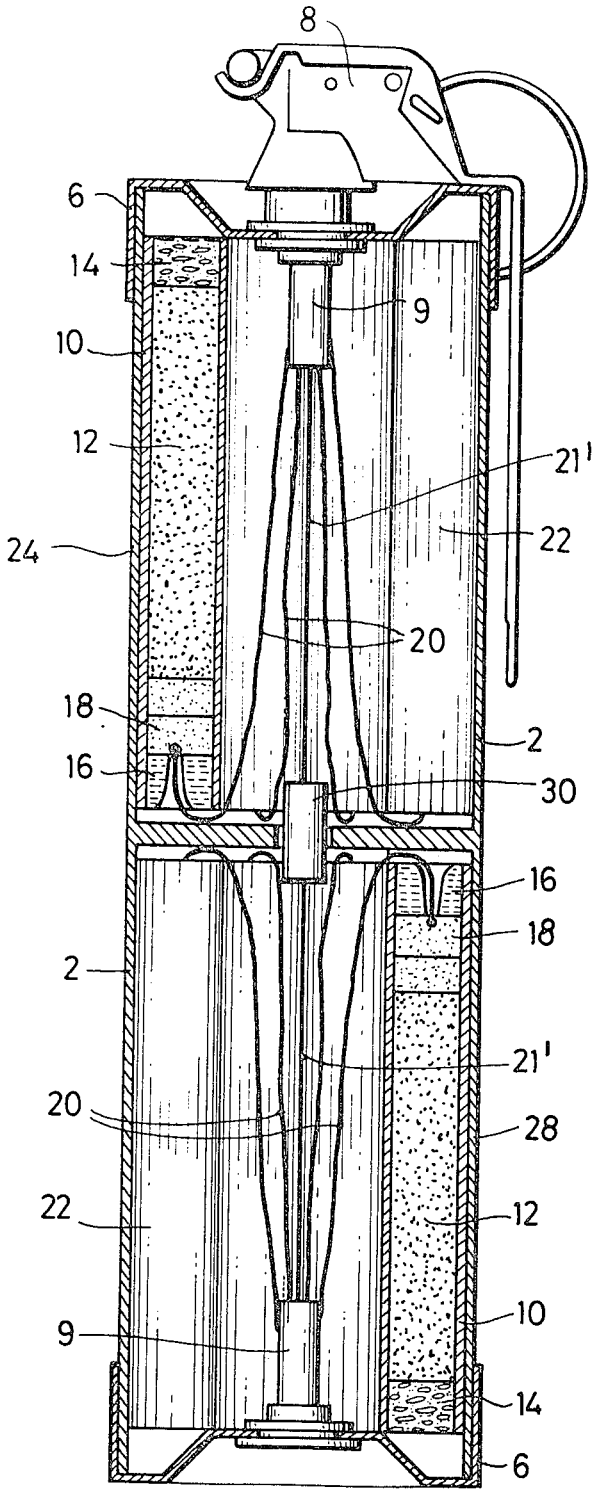
FIG. 5 is a schematic view of a composite projectile forming a third embodiment of the invention.

A third embodiment of the invention has been found to be particularly effective for controlling crowds. This embodiment is illustrated in FIG. 5 and includes the same reference numerals for the same equivalent parts as those used for the embodiments of FIGS. 1 and 2. The upper housing of the embodiment of FIG. 5 is constructed in a manner analogous to that of the embodiment of FIG. 1 or 2. Similarly, the lower half of the projectile of FIG. 5 is constructed in a manner analogous to that of the embodiment of FIG. 1 or 2. Thus the partition wall 26 and the delay charge 30 are also present in this embodiment of the projectile. The delay charge 30 is connected to delay charges 9 in the upper cup 24 and lower cup 28 via fuse cords 21'. The delay charge 30 is activated by the delay charge 9 in the upper cup 24. After a certain delay time the delay charge 30 activates the delay charge 9 in the lower cup 28 via the fuse cord 21'. Then a plurality of flash and acoustic charges 12 and/or smoke or irritant gas charges 22 as well as ejector charges 18 disposed in the lower cup 28 are ignited via fuse cords 20.

There is illustrated in FIG. 6 a projectile of the type illustrated in FIG. 5 which does not have the trip-lever fuse 8 but includes in lieu thereof the ejector charge E and the electrical conduits C which are connected to the ignition circuit I of a motor vehicle. The projectile of FIG. 6 is mounted in the launcher tubes T of the motor vehicle and is launched therefrom by way of igniting the ejector charge E.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A projectile adapted for crowd control comprising a housing containing a first delay charge, at least one ejector and scatter charge, and a fuse acting on the first delay charge for igniting the ejector and scatter charge, a plurality of elongated cylindrical flash and acoustic charges disposed in separate containers which are adapted to be ejected from the housing by the ejector charge without destroying the housing upon the ignition of the ejector charge, the housing having a lid which is blown off by gas pressure generated by ignition of the delay charge in the container without destroying the housing, at least one flash and acoustic shock charge is arranged in each container which is operatively mounted in the housing together with said ejector and scatter charge, said ejector and scatter charge being adapted to be ignited by the first delay charge via at least one fuse cord connected to said fuse.

2. A projectile according to claim 1, wherein said containers in which said flash and acoustic shock charges are arranged and are in the form of tubes which are arranged parallel to each other in the housing, each tube having a flash and acoustic charge and having an ejector and scatter charge mounted therein and a fuse cord connecting the ejector and scatter charge with the first delay charge, said lid being blown off after igniting of the fuse cord and before ignition of the ejector and scatter charge.

3. A projectile according to claim 2, wherein the ejector and scatter charges disposed in the individual tubes are of different explosive power.

4. A projectile according to claim 2, wherein the individual fuse cords are of different lengths.

5. A projectile according to claim 2, wherein the individual fuse cords have different rates of burning.

6. A projectile according to claim 2, wherein the individual fuse cords have different rates of burning and are of different lengths.

7. A projectile according to claim 1, wherein the fuse acting on the delay charge for igniting the ejector and scatter charge is a trip-lever fuse arranged in the lid of the projectile.

8. A projectile according to claim 1, wherein a smoke or irritant substance charge in the housing is disposed in a separate compartment which is separated from the flash and acoustic charge by a partition disposed in said housing, and an additional second delay charge is connected with the first delay charge by a fuse cord.

9. A projectile according to claim 2, wherein at least one of said tubes includes a smoke or irritant substance charge which is connected to said fuse via a fuse cord.

10. A projectile according to claim 8, including a booster charge operatively mounted in said separate compartment.

11. A method for ejecting a crowd control projectile having a plurality of charges disposed in separate tubes in said projectile from a launching tube of a motor vehicle, comprising the steps of actuating an ignition circuit in a motor vehicle to thereby ignite an ejection charge which ejects the crowd control projectile from a launching tube and which ignites a delay charge of said projectile;

selectively and sequentially igniting a scatter and ejector charge disposed in each tube of said plurality of tubes via a fuse cord connected, on the one hand, to the delay charge and, on the other hand, to the scatter and ejector charge; and thereafter ejecting a flash and acoustic charge or a smoke and irritant substance charge disposed in said tube from said projectile.

* * * * *